US006065166A

United States Patent [19]

Sharrock et al.

[11] Patent Number: 6,065,166

[45] Date of Patent: May 23, 2000

[54] SURGICAL SUPPORT CUSHION APPARATUS AND METHOD

[75] Inventors: Nigel Sharrock, New York; William Urmey, Larchmont, both of N.Y.

[73] Assignee: O.R. Comfort, LLC, N.J.

[21] Appl. No.: 08/733,629

[22] Filed: Oct. 17, 1996

[51] Int. Cl.[7] ..... A61G 13/12

[52] U.S. Cl. ..... 5/630; 5/652; 5/655.3

[58] Field of Search ..... 5/630, 632, 652, 5/655.3, 710, 713, 731, 81.1 R, 732, 631, 637, 644, 628, 425; 137/223

[56] References Cited

U.S. PATENT DOCUMENTS

| | | | |
|---|---|---|---|
| 726,054 | 4/1903 | Hartford | 5/425 X |
| 726,055 | 4/1903 | Hartford | 5/425 X |
| 744,713 | 11/1903 | Blomqvist | 5/630 |
| 2,276,911 | 3/1942 | Alward | 137/223 |
| 2,724,133 | 11/1955 | Sorrell | 5/630 |
| 3,287,747 | 11/1966 | Ellsworth | 5/631 |
| 3,369,548 | 2/1968 | Moore et al. | 5/637 |
| 3,505,695 | 4/1970 | Bishaf et al. | 5/655.3 |
| 3,678,926 | 7/1972 | Strittmatter | 128/94 |
| 3,790,975 | 2/1974 | Philipp et al. | 5/349 |
| 3,803,647 | 4/1974 | Reswick | 5/348 WB |
| 3,813,716 | 6/1974 | Francis | 5/348 R |
| 3,818,962 | 6/1974 | Muller-Scherak | 150/1 |
| 3,822,425 | 7/1974 | Scales | 5/348 R |
| 3,872,525 | 3/1975 | Lea et al. | 5/348 R |
| 3,897,777 | 8/1975 | Morrison | 128/133 |
| 3,939,829 | 2/1976 | Spann | 128/133 |
| 3,949,438 | 4/1976 | Scales | 5/348 R |
| 3,959,835 | 6/1976 | Nos | 5/368 |
| 3,984,595 | 10/1976 | Stephens | 428/35 |
| 4,025,974 | 5/1977 | Lea et al. | 5/367 |
| 4,042,988 | 8/1977 | Holliday | 5/349 |
| 4,054,960 | 10/1977 | Pettit et al. | 5/357 |
| 4,108,492 | 8/1978 | Kirby | 5/633 |
| 4,139,920 | 2/1979 | Evans | 5/367 |
| 4,234,982 | 11/1980 | Bez et al. | 5/628 X |
| 4,254,518 | 3/1981 | Bohren et al. | 5/732 X |
| 4,265,232 | 5/1981 | Stonich | 128/133 |
| 4,285,081 | 8/1981 | Price | 5/644 X |
| 4,371,999 | 2/1983 | Reid | 5/457 |
| 4,375,725 | 3/1983 | Orlob | 33/233 |
| 4,375,809 | 3/1983 | Meals | 128/90 |
| 4,394,784 | 7/1983 | Swenson et al. | 5/453 |
| 4,428,087 | 1/1984 | Horn | 5/449 |
| 4,488,715 | 12/1984 | Comeau | 269/328 |
| 4,534,078 | 8/1985 | Viesturs et al. | 5/452 |
| 4,639,960 | 2/1987 | Quillen et al. | 5/731 |
| 4,669,455 | 6/1987 | Bellati | 5/655.3 |
| 4,982,466 | 1/1991 | Higgins et al. | 5/453 |
| 5,012,539 | 5/1991 | Grigg | 5/431 |
| 5,070,559 | 12/1991 | Pettifer | 5/455 |
| 5,245,719 | 9/1993 | Ott | 5/632 |
| 5,418,991 | 5/1995 | Shiflett | 5/650 |
| 5,771,514 | 6/1998 | Wilhoit | 5/644 |
| 5,785,669 | 7/1998 | Proctor et al. | 5/655.3 X |
| 5,906,205 | 5/1999 | Hiebert | 5/713 X |

FOREIGN PATENT DOCUMENTS

| | | | |
|---|---|---|---|
| 1529538 | 3/1970 | Germany | 5/710 |
| 361887 | 11/1931 | United Kingdom | 5/655.3 |
| 1440193 | 6/1976 | United Kingdom | 5/710 |
| 2113990 | 8/1983 | United Kingdom | 5/655.3 |

*Primary Examiner*—Michael F. Trettel
*Assistant Examiner*—Robert G. Santos
*Attorney, Agent, or Firm*—Anthony J. Casella; Gerald E. Hespos

[57] ABSTRACT

A support cushion for a person in a lateral decubitus position, comprising a base, two lateral structural supports, and a central concavity, said lateral supports being sufficiently stiff to resist rolling of the person, said central concavity distributing a weight of the person. The support may be adapted for supporting the human flank above a surface, relieving pressure on an upper arm, and having comprising a structural bladder and a support cushion. The support cushion may be employed to limit a pressure on an upper arm and to maintain a patient in the lateral decubitus position during a surgical procedure.

6 Claims, 4 Drawing Sheets

SURGICAL SUPPORT CUSHION APPARATUS AND METHOD

FIELD OF THE INVENTION

The present invention relates to the field of inflatable cushions, and more particularly to the field of supports for the prevention of ischemia and nerve damage in or near the shoulder of humans in a lateral decubitus position.

BACKGROUND OF THE INVENTION

It is well known that immobilization of a person may lead to pressure sores, nerve damage ("Saturday Night Palsy"), decubitus ulcers and other problems. These types of concerns are particularly apparent in the field of anesthesiology, wherein a patient cannot voluntarily move, often for hours on end. Even when a person is conscious, sometimes supports or bolsters are desired for comfort or to prevent strain.

This problem, however, also occurs in normal persons who are immobilized for extended periods, persons with spinal cord injuries, persons required to sleep in the lateral decubitus position for respiratory purposes or due to sleep apnea, or hospitalized persons. Further, persons with impaired upper extremity circulation or nerve damage, e.g., to the brachial plexus, may be more susceptible to compromise due to forces incurred by laying in the lateral decubitus position.

Pads, pillows, bolsters and cushions are known which may be used for elevating body portions, maintaining the body in a lateral or inclined position, and which attempt to comfortably distribute the body weight. These pads, pillows and cushions are not, however, specifically designed for supporting a person in a lateral decubitus position, are bulky in storage, and have shortcomings. For example, a generally flat pad has limited conformability, and thus may produce pressure sores or decubitus ulcers. Foam rubber formed supports may be very bulky for the required height to relieve pressure on a shoulder, and have limited compressibility for extended storage. Thus, pads and foam rubber supports of sufficient size to raise and support the patient and to evenly distribute the forces generally consume large volumes during storage, and are difficult to dispose of when contaminated. Further, a heavier or denser patient sinks deeper, while a lighter or less dense patient rides high on the pad, suggesting the need for manual adjustment by an attendant to assure proper placement. However, such pads tend to have predefined configuration and time-consuming to adjust. Such pads and foam rubber supports also have limited abilities to restrict patient rolling, and in fact may promote undesired rolling by raising the center of gravity too high without providing a suitable lateral restriction.

In several surgical procedures of the lower extremity, the patient is rotated somewhat to the side to gain access to the lateral aspect of the leg. This is generally accomplished by placing a bolster beneath the lower back or hip region to tilt the pelvis up, thereby enabling the leg to be rotated. As presently employed, this method does not allow the position of the patient to be adjusted intraoperatively. The patient must therefore be positioned exactly as desired, or in the best compromise position prior to surgery. Due to the sterile field proximate to the bolster, repositioning the patient on the bolster risks infection.

In obstetrics, it is desirable to lift a hip of a patient by between about 20–40°. This inclination promotes uterine displacement, useful in all Cesarean sections and deliveries in the supine position. The uterus tends to compress the vena cava and/or aorta (the so-called aorto-caval compression syndrome), impairing blood flow to the fetus. This is usually minimized by placing the expectant mother in the left lateral position. During delivery with the mother's feet in stirrups or Cesarean section, the patient is placed on their back, requiring displacement of the uterus to the side. It is therefore known to place a bolster, usually formed from a bundle of sheets or a bag of intravenous fluid, under the side of the lower back and hip, to displace the uterus off the large vessels. When the baby is delivered, the bolster must be manually removed. If the displacement achieved by the bolster is later determined to be insufficient, there is no suitable means for adjustment.

It is also know to form pneumatic cushions using layers of polyvinyl chloride sheets, locally heated to fuse layers. These layers may form bladders or tensile members within bladders. Other types of pneumatic cushions using other materials and fabrication methods are known, for example, RF sealed polyurethane and nylon reinforced polyurethane. In these pneumatic cushions, a flexible wall of a bladder confines a gas space, generally having a uniform pressure, and therefore the bladder is inflated such the wall corresponds to this pressure. Where a sheet is fixed at two parallel edges, the center of the sheet will balloon outward with a cylindrical surface from a positive pressure in the gas space toward a lower pressure space. Two such sheets sealed at corresponding edges will thus assume a rounded, cylindrical form. A large bladder may be configured by forming tensile members within the bladder to locally restrain the expansion. Thus, grossly convex and piecewise concave shapes may be obtained using existing techniques.

In using pneumatic bladders devices to support a person, where sufficient pressure is provided in the bladder to assure a desired device configuration, without substantial or undue deformation due to the weight of the person, an uneven pressure may be applied to the skin of the person due to convex sections of the structure supporting the person. On the other hand, where the bladder pressure is low enough to allow uniform surface contact, the structural integrity may be impaired, and the inner walls of the bladder may locally contact each other or the structure may tend to roll. It is known to provide pneumatic bladder structures with separate inflation of multiple bladders, however these are often provided to separate bladders to provide increased safety of flotation devices or where gas spaces are not adjacent.

A known device, an Infusable® Disposable Pressure Infusor P/N IN-8000 available from Vital Signs, Inc., Totowa, N.J., includes a bladder formed of heat sealed polyvinyl chloride sheets, a pressure gage, a bulb pump, a vent valve and an inelastic bridging portion, for pressurizing an intravenous solution bag between one of the polyvinyl chloride sheets and the inelastic bridging portion.

U.S. Pat. No. 4,375,809 relates to an inflatable hand pillow for elevating the hand during healing. U.S. Pat. No. 5,012,539 relates to an inflatable medical support pillow for, e.g., elevating a body trunk or extremities. U.S. Pat. No. 5,418,991 relates to an inflatable structure for spacing legs, or supporting limbs, for example for immobilizing a leg. U.S. Pat. No. 3,897,777 relates to an inflatable head restraint. U.S. Pat. No. 4,139,920 relates to a body support designed to prevent decubitus ulcers. U.S. Pat. No. 5,070,559 relates to a pneumatic spinal support system having a plurality of types of bladders. U.S. Pat. No. 4,982,466 relates to an air mattress having controlled pressure to maintain subischemic conditions.

U.S. Pat. No. 4,265,232 relates to an inclined rigid arm support for stroke victims. U.S. Pat. No. 4,488,715 relates to an operating room rigid arm support having a foam padded interior surface. U.S. Pat. No. 3,939,829 relates to a foam restraining cuff. U.S. Pat. No. 3,678,926 relates to a stuffed support pillow for supporting a limb.

U.S. Pat. Nos. 3,790,975; 3,803,647; 3,813,716; 3,818,962; 3,822,425; 3,872,525; 3,949,438; 3,959,835; 3,984,595; 4,025,974; 4,042,988; 4,054,960; 4,371,999; 4,375,725; 4,394,784; 4,428,087; and 4,534,078 each relate to various air mattresses or structures auxiliary to air mattresses which are relevant to the background of this invention for implementing the structures disclosed herein.

Each of the patents cited herein is expressly incorporated herein by reference for its disclosure of aspects of the design, materials, manufacture and use of various pneumatic and support devices.

SUMMARY OF THE INVENTION

The present invention therefore provides a pneumatic support cushion providing even weight distribution of a person, lateral support to maintain a desired position, adjustable inflation and efficient storage.

The purpose of the pneumatic support cushion according to the present invention is to maintain a human in a lateral decubitus or lateral inclined position, for support of the flank portion, for example during surgical procedures or at rest. Relevant surgical procedures include, for example, total hip arthroplasty, thoracotomy, kidney surgery, and shoulder arthroscopy in a lateral position. Therefore, the support cushion structure includes at least one member suitable for preventing rotation or rolling out of the lateral decubitus or inclined position, and a section providing cushioned support above a surface so that the arm and shoulder are relieved of the forces of the body while distributing the body weight on the skin surface.

Embodiments of the pneumatic support cushion according to the present invention may be used to support a patient at any desired inclination, and therefore the use of the device is not limited to support of a patient in the lateral decubitus position. For example, an embodiment may be used to lift a hip of a patient by between about 20–40°, a position useful in obstetrics to prevent aorto-caval compression syndrome, impairing blood flow to the fetus. An inclined position at about 30° is also useful for kidney surgery and lower extremity surgery on the side of the leg. By providing an adjustable inflatable cushion, the patient may be placed on a flat table, with the cushion thereafter inflated to a desired level and readjusted as necessary to achieve a desired effect, e.g., uterine displacement or surgical access. Thus, the inclination of the patient may be varied by control or adjustment of the inflation of the cushion. After the procedure, the cushion may be deflated to allow removal of the patient and to increase storage efficiency.

In cases where the patient is inclined, rather than supine or in a traditional lateral position, the preferred shape of the pneumatic support cushion is grossly asymmetric, with one side being wedge shaped having a large area inclined surface suitable for supporting the lower back and possibly the hip of the patient at the desired inclination, with the other side tapered to a minimum lift distance off the operating table with a lip or upwardly extending portion at the edge to help prevent slippage of the patient off the support cushion, and possibly off the table. The lip or upwardly extending portion is preferably limited in size so as not to impede access by the surgeon to the patient. It is preferred that the cushion be linked to the table to prevent slippage of the cushion, and to ensure proper positioning of the cushion prior to inflation. The linkage is preferably a strap or belt which encircles the table, and may be provided as a pair of straps which link by means of a Velcro® fastener. The lip may be replaced with another type of patient restraint system, such as a webbing, belt, strap, fixture., railing, or the like. Such a separate or non-pneumatic restraint system is preferred, for example, where the cushion is placed below a mattress pad, and therefore the restraining effects of a pneumatically inflated bladder lip would be reduced or interfered.

By providing an adjustable inflatable support cushion, a number of advantages accrue as compared to the known bolster techniques. First, by adjusting the cushion inflation, an inclined patient may be rotated at will, from a location remote the cushion, during a procedure, with reduced risk of impairing the sterile field. Depending on the stage of surgery, the cushion may be adjusted to reposition the patient to maximize surgical exposure; thus, the initial patient position need not be a compromise of the desired positions during the course of the procedure. With a fixed bolster, it was considered necessary to rotate the table to provide improved surgical access, which is clumsy and increases risk of slippage of the patient and/or surgical items on the table. By providing an inflatable cushion which has a compliant, weight distributing surface, the use of other positioning devices, such as posts, bean bags, and the like, which may contribute to pressure injury, is not necessary.

In some instances, such as delivery room suites, it may be desirable to employ a support cushion in a large proportion of procedures. In this case, the support cushion may be provided as a reusable structure, for example provided under a cover or below a mattress pad. In this case, the pneumatic support cushion may be inflated after the patient is placed on the table, and the inflation may be further adjusted as desired or necessary. An inflatable bladder may also be used to reposition a support for a mattress, thus effectively altering a shape or inclination of a portion of an operating table surface. Where the support cushion is reusable or permanent, the cushion may dispense with a lip or second upward protrusion. In this case, another means for preventing undesired slippage or roiling of the patient is provided, such as straps, a separate bolster, rails, or other known restraints or limits. Where the support cushion does not itself have integral means for preventing undesired slippage or rolling, the support cushion tends to have a wedge-like configuration. On the other hand, where the support cushion is disposable and in close proximity to the patient, a preferred embodiment includes a pneumatic restraint device to maintain a positioning of the patient with respect to the support cushion and to prevent rolling or slippage. The pneumatic restraint device takes the form of a lip, which has sufficient height to prevent the patient from involuntarily slipping over the lip under normal conditions. Generally, this lip will have a higher inflation pressure than the supporting portion of the cushion, and will be separated from the supporting portion bladder by at least one septa or wall. The inflation of the lip bladder may be separately controlled or provided by way of a relief valve structure.

The pneumatic support cushion according to the present invention, whether intended to be disposable or reusable, is preferably affixed to the supporting surface, e.g., operating table, by a fastener, such as Velcro® straps, snap, hooks, or other means. This means for affixing further assures that the pneumatic support cushion positions the patient appropriately. Of course, where the pneumatic support cushion is used to treat sleep apnea or to alleviate shoulder discomfort at home, the support cushion need not necessarily be rigidly held in fixed position.

In a pneumatic structure, variations in rigidity may be obtained by variations in inflation pressure. On the other hand, where a number of interconnected bladders are inflated through a free passage, the pressure in each bladder will be equalized. Therefore, in such a single gas space system, lateral support may be impaired, allowing rolling of the body due to a redistribution of the gas volume within the interconnected bladders. Further, in order to provide acceptable support and even weight distribution in a configurationally controlled device, the inflation pressure must therefore be a compromise. Therefore, according to one embodiment of the invention, the pneumatic support cushion includes a segmented system, providing gas spaces, e.g., bladders, having a plurality of possibly different inflation pressures. By providing such segmented inflation pressures, a rigid support structure may be provided laterally, with a softer central section inflated to a lower pressure. In this case, where the central section is not over-inflated, it assumes a pressure which corresponds to about the weight of the person divided by the effective area on the support. On the other hand, the lateral supports are preferably inflated to a higher pressure, relying on the wall tension of low compliance lateral bladder walls, to provide structural rigidity. In one embodiment, a unified inflation system is provided which is self-adjusting, by the use of internal pressure relief valves to maintain a desired pressure differential. However, separated inflation systems or permanent inflation states may also be provided in some or all gas spaces. By employing a plurality of pneumatic spaces, the need for auxiliary padding may be reduced or eliminated, allowing efficient storage and disposal. Where the support cushion contacts or comes into close proximity to the skin or the surgical field, the cushion should be disposable to prevent the spread of disease and facilitate maintaining sterility of the operating field. The absence of padding reduces medical waste and increases inventory storage and disposal efficiency.

On the other hand, in order to conform to the skin of the person, a soft or compliant pad may also be provided between the pneumatic bladder and the person. Thus, the support cushion according to the present invention may be used in conjunction with auxiliary padding, such as foam rubber, elastic polymer, fiber fill, hair, a gel cushion, a spring cushion, or other known cushioning, to assist in evenly distributing the weight of the person while reducing the need to compromise the inflation pressure for comfort. The support cushion may also be situated beneath a mattress.

Therefore, the required compliant surface of the support cushion may be achieved by providing an inflation pressure such that the surface is pliant, not stiff, providing a special covering pad or cushion over the pneumatic support cushion, or providing the support cushion beneath a mattress, which itself is designed to evenly spread the weight of the person, to prevent sores and damage to skin and underlying structures.

In another embodiment of the pneumatic support cushion according to the invention, a rigid mechanical support structure is provided as a frame, with a pneumatic cushion or cushions provided on or within the frame to support the person. By providing a rigid mechanical support, the pressures in the bladders may be maintained at a uniform level, and the tension on the bladder walls is not relied upon for structural rigidity. The mechanical supporting structure may be reusable after, for example, sterilization, or may be disposable with the pneumatic cushions after contamination.

In order to provide efficient storage and transport, the pneumatic support cushion is preferably deflatable. Further, because the pneumatic support cushion is used during surgical procedures, it is preferably efficiently disposable and of low cost construction. Thus, one embodiment according to the invention provides a self-inflating pneumatic structure, such as a carbon dioxide cartridge, with a large bore dump valve to facilitate deflation. The inflatable device may thus be rapidly deflatable.

In a preferred construction, a series of elongated interconnected parallel bladders are formed by heat sealing a number of bladders between plastic sheets. These planar sealed sheets are then folded to form a three dimensional structure to provide support for the flank and body rotation resistance, as well as even body weight support. In one embodiment, straps are selectively placed around the potential bladders, so that when inflated, a suitable supporting structure may be obtained, relying on the straps to create and maintain the desired configuration. These bladders may be segregated between higher pressure structural bladders and lower pressure support bladders by one or more suitable pressure relief valves, or by providing separate inflation systems or a separation valve. The high pressure bladders are filled directly by a compressed gas source, e.g., a manual bulb pump, foot pump or electrical pump, or a compressed gas, e.g., air or nitrogen, line. The low pressure bladders may also be filled by the compressed gas source, or may be filled through the relief valves from the high pressure bladders, which ensure a pressure differential.

The pressure relief valve system according to one embodiment of the invention operates as follows. As the relative pressure or inflation level in the low pressure bladders increases beyond a defined level, with the person in place, the pressure relief valve closes, and inflation of the low pressure bladder stops, while the inflation of the high pressure bladder may continue. In one embodiment, when the pressure in the high pressure bladder is reduced, the pressure relief valve acts also as a check valve, allowing the gas in the low pressure bladder to dump. Alternately, the low pressure bladder may be separately vented.

In order to adjust the pressures within the device, manual relief valves and/or bulb pumps may be used. Thus, while the primary inflation source may be a compressed gas line, a secondary inflation source for fine adjustment may be a manually operated pump or manual relief valve.

By providing a series of parallel interconnected bladders with heat sealed septa, a structure similar to known air mattress designs is obtained, allowing known fabrication techniques, apparatus and materials to be employed.

According to another embodiment of the invention, the weight distributing portion of the cushion is provided with a design feature including a mechanism for varying the support cushion inflation pressure or volume of one or more support bladders, separately or together, over time. This serves to relieve local pressure at the skin briefly to allow microcirculation to return, or to act as a peristaltic pump to assist in circulation within the supporting tissue. This variation may be accomplished in a number of ways. First, an air or nitrogen line may be connected to the pneumatic support cushion continuously feeding gas to the device, which includes a cycling valve. The low pressure support cushions are provided as a plurality of independently controlled bladders which sequentially partially fill and partially deflate. The control over the bladders, e.g., cycling valve, may be electronic, pneumatic or mechanical. Thus, where fine movements of the patient are acceptable, the pressure relief on the supporting body portions of the patient may be automated. On the other hand, where such movements would be objectionable to the surgeon, for example in delicate surgery, the readjustments may be manually initiated. In this case, a timer may be provided to alert the anesthesiologist or surgeon that a readjustment may be warranted.

It is noted that the pressures in the bladders are relatively low. For example, if the support bladder supports one half the weight of an approximately 200 lb. adult over a surface area of about 70 square inches, the pressure necessary in the bladder is about 1.4 psi. Likewise, the structural bladders are provided to prevent inadvertent shifting of the patient, due to, for example, the force of retractors or the surgeon, or shifting of mass. Thus, it might be desired to provide a force of about 25 lbs against inadvertent shifting of the patient, with a center of gravity low enough to allow resettling after a shift. Thus, if the surface area restraining the side of the patient is about 35 square inches, an increased pressure of about 1 psi may be desired, resulting in a total side bolster pressure of less than about 2.5 psi. It is noted that the pressure in the side bolsters is determined by the volume of gas and the compliance of the walls. Thus, during patient shifting, the pressure in the side bolsters may be seen to increase. The peak pressure occurs dynamically, and the static pressure need not be maintained at this level.

The center of gravity of a human on disposed on the support preferably remains within a projection of the flank of the human when subject to a lateral force of less than about 25% of the weight of the human. Thus, under conditions of a lateral force of less than about 25% of the weight, the human is stably supported and will tend to return to position after removal of such a force. On way to achieve such stability is by providing a lower base portion of the support, the lower base portion being about twice as wide as the concave upper depression which supports the human.

In order to maintain its three dimensional configuration, a set of low compliance straps external to the bladders may be provided. These straps may, for example, penetrate through apertures in the inter-bladder septa. Thus, the strap may be held in place under the patient, allowing the weight of the patient to assist in preventing inadvertent shifting. Further, the bladders, in particular the lower bladders, need not be filled with gas, and in fact may also be filled with water or another fluid. Thus, the weight of the water will produce a lower resultant center of gravity, while the support cushions will act in the manner of a water bed to distribute the weight of the person. The lateral restraint system, e.g., side bolsters, however, preferably remain pneumatic., in order to maintain the low center of gravity and reduce pressure variations, and to reduce potential water spillage in the event of a puncture. In addition, a pneumatic bladder is compressible, increasing shock absorption capability and increasing comfort. In fact, the bladders are preferably segmented, so that support and structural integrity is maintained in the event of an accidental puncture. As stated above, controlled dynamic inflation of these separate segments may also be used to relieve surface pressure by relative variations, as desired.

In some instances, it may be desirable to provide a reusable support cushion which is manually adjustable or customized for a person, for example for persons with sleep apnea or shoulder discomfort when lying on their sides. In this case, the inflation and/or structural configuration of the support cushion may be modified to optimize the cushion for the person. Preferably, such a device is provided as a small number of models for persons of grossly varying sizes and shapes (e.g., small, medium, large), with individualized adjustment by varying inflation levels or varying the inflation pressure of certain bladders within the structure. Likewise, where relief valves are provided to control pressure differentials within the device, the relief pressures may be adjustable to achieve desired compliance properties and shape. Further, while the device as generally described herein is formed of impermeable sheet material with low compliance, it is also possible to form some or all portions of the support cushion with materials having a high compliance. Thus, for example, a structural support portion of the device may be formed of materials having low compliance, and thus being rigid when inflated, and a body support portion having high compliance, and thus adaptive to the body shape when inflated. Preferably, the gas spaces within such structures are separated to allow better control over the overall support cushion configuration and properties.

In order to customize the physical configuration of the support cushion, a set of mechanical fastening or restraining devices may be selectively engaged, thus restricting the configuration of the support cushion when inflated. Thus, various sets of mechanical fastening or restraining devices may be provided to allow incremental variation in various parameters of the device. Such mechanical fastening or restraining devices may include Velcro® (statistic hook and loop fastener) straps, snaps, rigid or elastic flexible straps (e.g., rubber, fiber webbing, rope, etc.), hooks, staples, glue or adhesive, fusion bonding of portions of bladder walls, etc. These sets of mechanical fastening or restraining devices are provided at selected portions of the support cushion to facilitate sizing without making adjustment complex.

In defining the mechanical configuration of the support cushion, it may be desirable to produce an asymmetric cushion, for example to incline the torso at an angle instead of supine, to more accurately conform to front and back, to compensate for anatomical features, e.g., breasts, and the like. Thus, there are generally at least three functional components in the pneumatic support cushion. First, the weight distributing supporting portion; second, a structural portion to maintain a desired device configuration and positioning of the person; and third, a restraining portion, to restrict rolling or shifting off of the device. In this case, the upper portion of the support cushion may be adapted for supporting much of the weight of the person, while a lip or other restrain system provided more particularly as a safety feature to prevent unintended rolling. With this asymmetry, it is apparent that the configuration of upward extensions may be very different, based on the difference in intended function. Thus, where the restraining portion and the supporting portion are both pneumatic, the device will obtain a generally "U" shaped configuration. Where the configuration is intended to support the person in an inclined position, the device may be asymmetric, with an upper concavity not having a strictly cylindrical profile.

The entire three dimensional pneumatic support cushion structure may be encased in a sheath, which is, for example, a paper, fabric or plastic sheet.

In use, the person may be placed on a preinflated structural support, with final inflation parameters adjusted after the person is in near final position. On the other hand, the person may also lie on an uninflated support, with inflation initiated after the person is positioned appropriately. The support may be provided under the surgical drapes, or on top of the drapes. When under the drapes, sterility is preferred, but not absolutely required. On the other hand, when placed over the drapes, sterility is generally required. A sterile disposable pneumatic support cushion may be provided by ethylene oxide, gamma ray, or other known sterilization techniques. Where the materials allow, heat sterilization may also be used. A reusable pneumatic support cushion is preferably steam sterilized, in order to kill bacteria within the structure, and is therefore fabricated of materials which will withstand repeated sterilization procedures.

In order to maintain low cost and ease of use, the pneumatic support cushion preferably has a single inflation system with simple or automated controls, although as stated above, complex and sophisticated inflation and deflation systems are possible. Deflation preferably occurs quickly, e.g., within about one to two minutes, and relatively completely, for efficient disposal or storage after use.

In a preferred embodiment, for supporting a person in a lateral position, the pneumatic support cushion will generally be about 10 to 18 inches long and is "U" shaped with a minimum height of about 1–6 inches and a maximum height of about 2–8 inches. The volume of inflation required for normal use will be about 0.2 to 1 cubic feet of gas at 1.5–3.0 psi. Therefore, a manually operated bulb pump may be used, or otherwise a foot pump or compressed gas supply line may be used for inflation. Electrical pumps may also be used, although hospital environments and operating suites generally have strict electrical requirements for such devices, and generally have a readily accessible suitable compressed gas source. On the other hand, manual bulb pumps are more suitable for low volumes, and large inflation volumes may be tiring for personnel and require extended periods for adequate inflation.

It is therefore an object of the invention to provide a pneumatic support cushion for use during surgery to relieve pressure on an arm or shoulder and further to provide pressure equalization on the skin and underlying structures.

It is a further object according to the present invention to provide a support cushion to position a person in a lateral decubitus condition while preventing undue forces on the arm and shoulder.

It is also an object according to the present invention to provide a support cushion to position a person in a stable, adjustably inclined position on a support surface.

It is a further object according to the present invention to provide a support cushion for use during surgery to support and position the person, yet is compact during storage and of low cost.

These and other objects will become apparent through a review of the drawings and detailed description of the preferred embodiments.

DETAILED DESCRIPTION OF THE PREFERRED EMBODIMENTS

Figure 1:
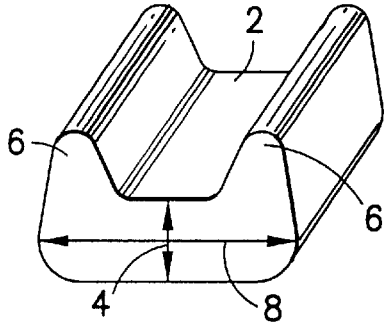
FIG. 1 is a perspective view of a support cushion according to one embodiment of the present invention.

The preferred embodiments will now be described by way of the drawings, in which corresponding structures are referenced by like reference numerals.

FIG. 1 shows a perspective view of one embodiment of a support cushion according to the present invention. In FIG. 1, it can be seen that there is an upper concavity 2, adapted for supporting a person lying in the lateral decubitus position. The supporting structure extends from the hip or above the waist to an area below the arm. The thickness of the base portion 4 is such that the pressure of the body is relieved from the arm and shoulder. Thus, this distance is between about 4–8 inches. The amount of lift is limited due to potential instability due to a high center of gravity. therefore, this height is kept to a minimum for a given person. The height of the side bolster 6 structures, which act as lateral restrains, is sufficient to counteract a rolling torque due to forces exerted during the procedure or shifting. Furthermore, the width of the base 8 is preferably about 15–24 inches, to ensure stability. The concavity 2 is preferably formed without a tactile seam, in order to avoid localized pressure on the skin of the person.

Figure 2:
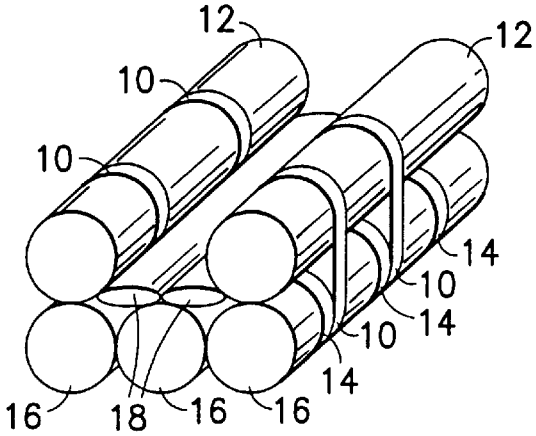
FIG. 2 is a perspective view of a pneumatic bladder structure of a cushion according FIG. 1.

FIG. 2 is a perspective view of a pneumatic bladder structure of a cushion according to the present invention. As shown in the figure, a set of straps 10 are provided to apply forces which tend to maintain the configuration of the structure during use. Most importantly, the side bolsters 12 are held in lateral position and deter spreading. Much of this force is derived from the weight of the person, so that the rigidity of the structure will tend to be self compensating for the weight of the person. Another set of straps 14 is provided to hold the base in close association, reducing the inter-bladder gaps. As shown in FIG. 2, a typical configuration includes seven bladders, five of which comprise the base 16 and bolster 12 portions, and two of which comprise the pressure distribution portions 18. The pressure distribution portions 18 develop a pressure based on the weight of the person and his effective surface area. The base 16 and bolster 12 portions, on the other hand, are inflated past a "knee" in the compliance curve of the walls of the bladders 12, 16, so that the walls are taut. Thus, the walls of these higher pressure bladders 12, 16 are essentially the supporting structures, along with the straps 10. As noted in FIG. 2, the bladders extend lengthwise, and may be arbitrarily long. In another embodiment, not shown in the drawings, each bladder is segmented lengthwise, to form a plurality of parallel systems, to support the person even if one system is punctured, such as by "sharps" during surgery or the like.

Figure 3:
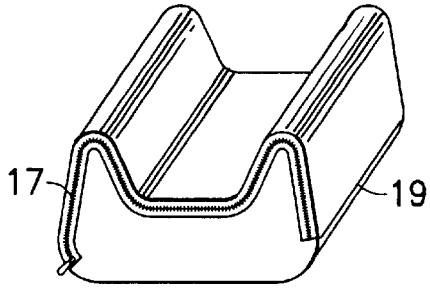
FIG. 3 is a perspective view of a fabric encasement for the support cushion according to FIG. 1.

FIG. 3 is a perspective view of a fabric sheath 19 for the support cushion, having a zipper closure 17 at one end. The support cushion fits inside the fabric sheath 19. The fabric sheath 19 may therefore be used to maintain the shape of the pneumatic structure. This fabric sheath 19 is formed, for example, of paper, mesh or cloth, and covers the bladder structures. Thus encasement may optionally have further padding properties or act as a sterile barrier.

Figure 4:
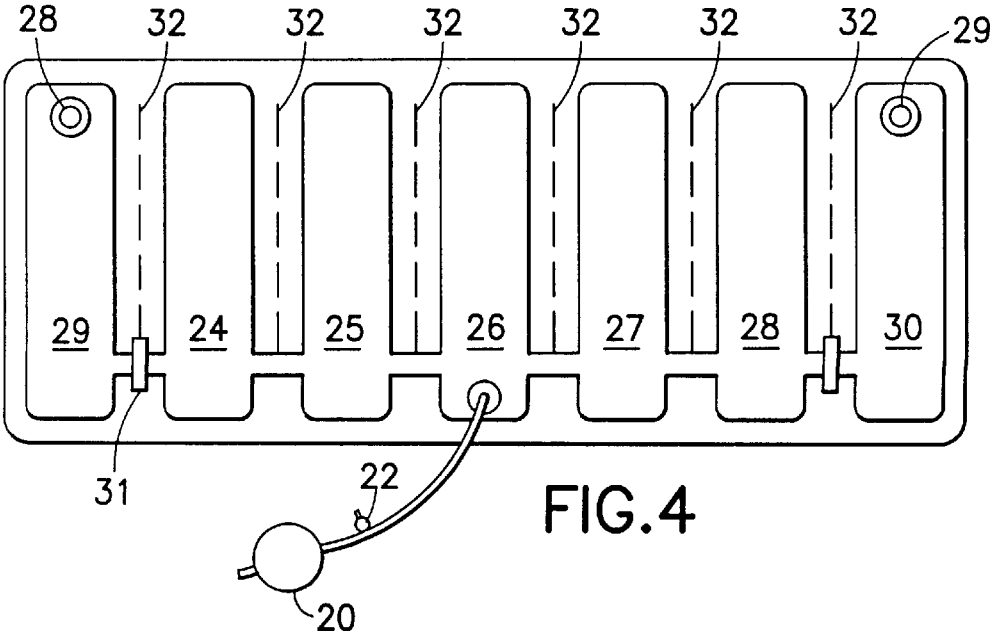
FIG. 4 is a top view of an unfolded, uninflated bladder structure according to FIG. 1.

FIG. 4 is a top view of an unfolded, uninflated bladder structure according to an embodiment of the present invention as shown in FIG. 1. As can be seen, the essential pneumatic structure may be formed as a planar structure, heat sealed to define bladders, septa, and interconnections between a pair of sheets. As also seen in the drawing, an inflation bulb 20 is provided, which has a pressure gage 22 to allow determination of the structural cushion 24, 25, 26, 27, 28 pressures. The support cushions 29, 30 each have a dual function valve structure 31, which acts as a check valve to allow deflation of the support cushion, as well as a pressure relief valve which maintains the pressure differential in the structural and support cushions. This valve 31 is shown in more detail in FIG. 5. Also shown in FIG. 3 are apertures 32 between the bladder structures 24, 25, 26, 27, 28, 29, 30 where a strap may penetrate.

Figure 5:
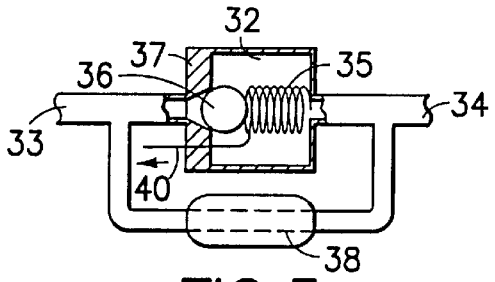
FIG. 5 is a cross section of a pressure control valve according to an embodiment of the present invention.

FIG. 5 is a cross section of a pressure control valve 31 according to the present invention. As can be seen from FIG. 5, a first portion of the valve 32 creates a pressure differential between the side bolster structural cushion 33 and the central support cushion 34, by means of a pressure relief valve with a spring 35 to provide a force against a ball 36 in a valve seat 37. With this differential maintained, the structural cushions will be harder than the support cushions. On the other hand, a check valve 38 allows gas to exit the support cushion 34 when the pressure exceeds the structural cushion 33 pressure, allowing deflation and maintaining a desired relationship during transient pressures. The check valve is formed by overlapping flaps of smooth compliant material, such as a polyvinyl chloride film which forms the walls of the bladders.

In an alternate embodiment, the inflation or filling of the support cushion bladder is based on a dimension, e.g., length along one, two or three axes (length, area or volume) to control a valve from a structural bladder. For example, the actuator 40 shown in FIG. 5 applies a force to against the ball 36 in the valve seat 37 to prevent further inflation. Thus, when a person having a higher density is situated on the support cushion 34, the pressure in the support cushion 34 bladder 18 will attain a higher pressure. On the other hand, when a low density person, such as a child or geriatric adult, is situated on the cushion 34, a lower pressure will be developed in the bladder 18, so that the same dimension is obtained. A dimensionally responsive valve generally thus has an actuator 40 which controls displacement of a valve body. Where the control dimension is insufficient, the valve body is open, allowing flow through the valve. As the support cushion bladder 18 fills, it expands, and the actuator 40 is displaced. At the set point, the displacement of the actuator 40 closes the valve body and blocks further flow. This system allows, for example, the person to be held at a constant height off the operating table, so that the lateral supports do not envelope a patient and block surgical access. It is noted that the control dimension need not merely compensate for the inflation of the support cushion bladder 18, and for example may compensate for the upper extension of the topmost flank of the person. Further, where the dimensional control is not specifically for control of the properties of the support cushion, a variable dimensional bladder may be provided as a separately controllable element.

A person density responsive valve operates by approximating density, normally expressed as pounds per cubic inch, as pounds per square inch exerted on the support cushion. (Where the person is supported on a waterbed-type structure, a true density may be estimated by determining a displacement of water volume.) Where the support cushion is flaccid before the person is placed thereon, the pressure within the support cushion will closely correspond to the weight of the person divided by the effective surface area on the cushion. Thus the pressure within the cushion may be deemed a reasonable surrogate for person density under these circumstances. Where this approximation is insufficient, the depression of the center of the support cushion due to the person may be determined, which may yield a truer density estimate. The depression, in turn may be sensed with an actuator 40. However, it is not generally necessary to rigorously determine the density of the person.

Figure 6:
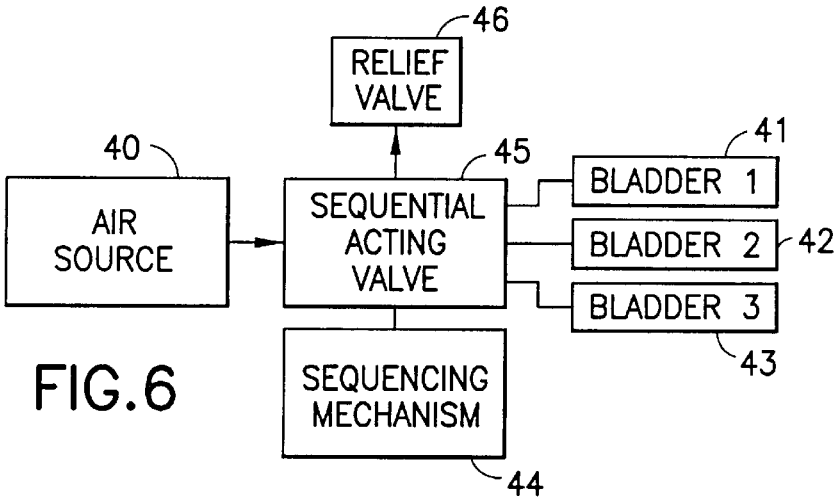
FIG. 6 is a schematic view of a time-varying inflation pneumatic support cushion embodiment according to the present invention.

FIG. 6 is a schematic view of a time-varying inflation embodiment according to the present invention. This embodiment provides a flow of pressurized air or nitrogen from a gas source 40 to continuously inflate the support cushion bladders 41, 42, 43, which are periodically deflated through a relief valve 46. Thus, a dynamic condition exists, controlled by a sequencing mechanism 44, which controls a sequencing valve 45. This dynamic condition assists surface tissue circulation and prevents pressure sores.

It is noted that various types of valves may be used. In a reusable device, it is preferred that these valves be reliable and long lasting, while in a disposable device cost is a more critical issue. Pressure responsive valves may be formed by placing a valve body in a throttle position, with a spring or other controlled force generating member pressing against the valve body. Thus, a typical pressure relief valve includes a conical tapered aperture 37 with a ball 36 resting in the conical taper. A spring 35 presses the ball 36 toward the aperture 37. The force on the ball 36 through the aperture 37 must exceed the force on the ball 36 from the spring 35 to crack the valve and allow flow. Another type of pressure controlled valve is an umbrella valve 29, in which a compliant material forms a circular valve seat fixed in the center. For example, an umbrella valve 29 is employed to limit pressure in the relatively low pressure support cushion bladders 30. The pressure differential flexes the compliant material, allowing flow. In general, spring controlled valves will have higher repeatability and useful lifetime than umbrella valves, while umbrella valves may be less expensive, more compact, and have better integration into the manufacturing process for heat sealing bladders between sheets of a plastic material. A dimensional or displacement responsive valve substitutes or supplements a relative movement of an actuator 40 for the spring or compliance of the valve seat to control valve cracking. Thus, a string, filament, strap, or other connecting element senses the dimensional change, allowing flow through the valve. A combination valve type is also possible, being responsive to a hybrid of one or more of absolute pressure, differential pressure, bladder wall tension, displacement or density.

Figure 7:
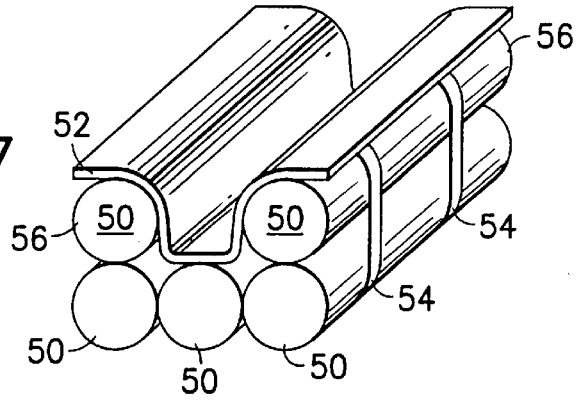
FIG. 7 is a perspective cutaway view of a second embodiment of the present invention having pneumatic structural supports and a foam rubber weight distribution layer.

FIG. 7 is a perspective cutaway view of an embodiment of the invention having pneumatic structural supports 50 and a foam rubber 52 weight distribution layer. In this case, the compactness of storage and disposal is reduced, in favor of structural simplicity and the known and accepted properties of the foam layer. Thus, the pneumatic bladders 50 are all filled to a structurally supporting pressure. A foam rubber 52 layer, e.g., a closed cell foam, is provided on top of the pneumatic bladders 50. The foam rubber 52 provides pressure equalization and prevents pressure sores in known manner. In this case, the straps 54 may be used to maintain the side bolsters 56 in a desired configuration. Alternate types of mechanical cushion include continuous or granulated structure foam rubber having open or closed cell, having a skin or a cut edge, and being flat or having a large featured texture, such as a so-called "egg crate" design, spun fibers, such as polyester or natural fibers, such as cotton. Preferably, the foam rubber is a closed cell polyurethane foam in an egg crate design.

Figure 8:
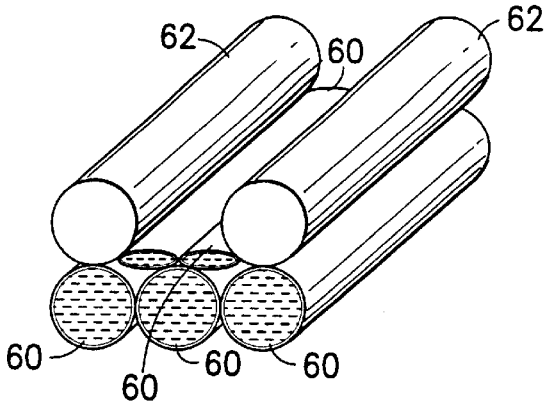
FIG. 8 is a perspective cutaway view of a third embodiment of the present invention having water filled pressure distribution bladders.

FIG. 8 is a perspective cutaway view of an embodiment of the invention having water filled pressure distribution bladders 60. In this case, the hydraulic bladders serve two functions. First, they support the person with a buoyant force, equalizing pressure in the manner of a known water bed. Secondly, the water provides a heavy base which lowers the center of gravity and resists tipping of the person. In this case, the side bolsters 62 are preferably pneumatic, to maintain the low center of gravity and prevent substantial pressure gradients from causing the lower bladders to have high pressures. The water may be typical tap water, or treated with an antiseptic material.

Figure 9:
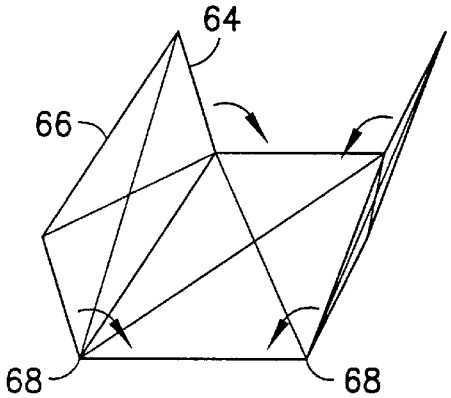
FIG. 9 is a perspective cutaway view of a fourth embodiment of the invention having a mechanical support structure.

FIG. 9 is a perspective cutaway view of a mechanical support for an embodiment of the invention. In this case, the structural support functions are provided by solid elements, so that pneumatic elements placed inside the mechanical support 64 need only support the person and provide padding. In this case, the structural elements form a frame structure 66, which may fold or collapse for storage with hinges 68. This mechanical support structure may also have foam rubber padding.

Figure 10:
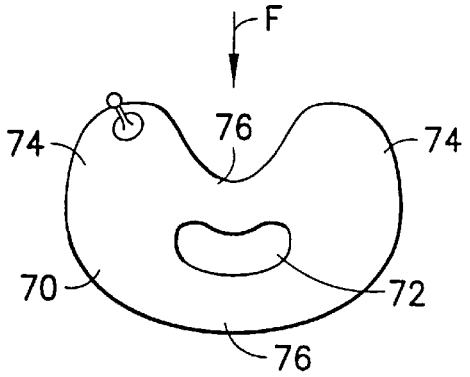
FIG. 10 is a perspective view of a toroidal pneumatic structure which is deformed due to a force.

FIG. 10 shows a support cushion formed as a toroidal inflated structure having a single bladder 70. This single bladder 70 is inflated partially, so that a person sinks into the central portion 72 when on the structure, thus equalizing the pressure based on the weight of the person. In this case, side portions of the torus 74 bulge, due to the increased pressure, providing support and lateral restraint. The central portions of the torus 76 are depressed by the force F of the person, and form a concave depression.

Figure 11A:
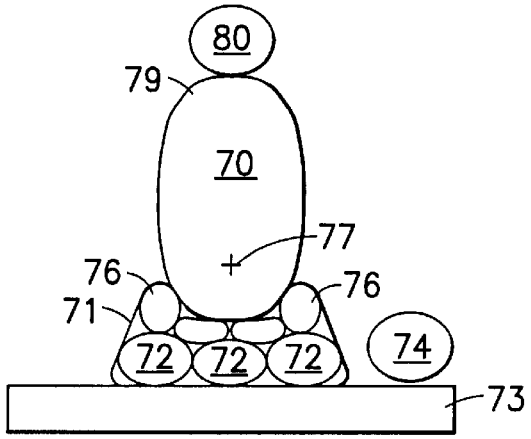
FIGS. 11A and 11B are cross sectional and perspective views, respectively of a person in the lateral decubitus position, supported by the support cushion according to FIG. 1, supported by an operating table.
Figure 11B:
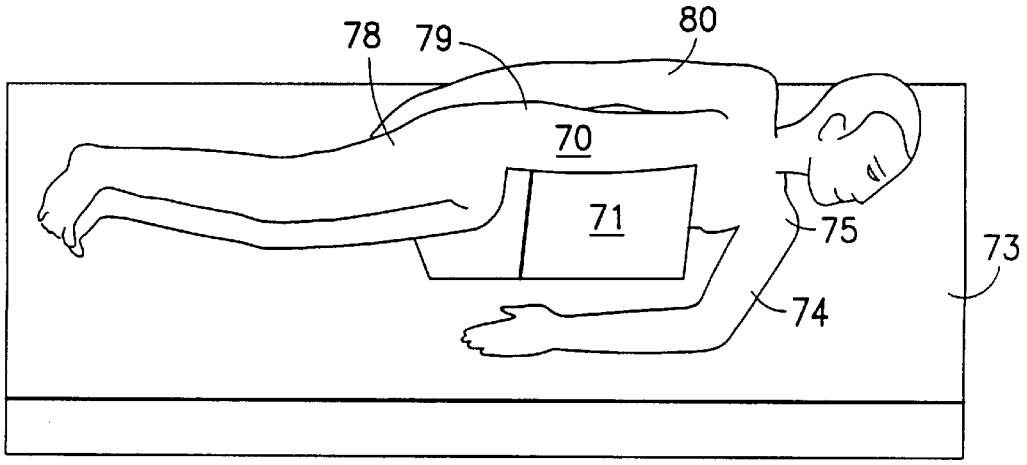

FIGS. 11A and 11B show a person supported in the lateral decubitus position by a pneumatic support cushion according to the present invention. FIG. 11A shows the torso 70, supported by the support cushion 71, shown in FIG. 11 in cross section. Thus, the base structural bladders 72 lift the person's torso 70 off the operating table 73, while relieving compression on the arm 74. Thus, the lower shoulder 75 of the person is relieved of strain and assumes a normal position. The torso 70 is prevented from rolling forward or backward by the lateral bladders 76, which cooperate with the structural bladders 72 for maintaining a center of gravity 77 well within the lateral confines of the border of the support cushion 71, requiring a significant force to unseat the person from the support cushion 71. As shown in FIG. 11B, the support cushion 71 supports the torso 70 of the person below the shoulder 75 and above the hip 78 areas, and provides free access to an upper flank 79 portion. The upper arm 80 is shown on top of the upper flank 79 portion, but may of course be repositioned.

Figure 12A:
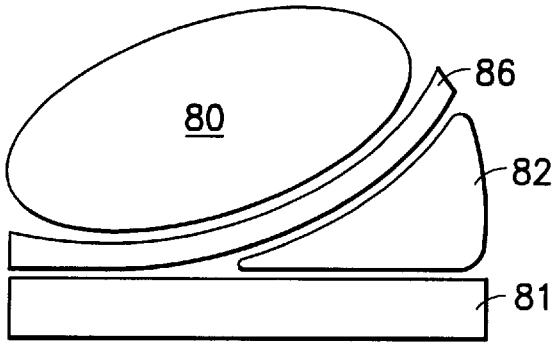
FIGS. 12A, 12B and 12C show embodiments of the invention intended to maintain a person in an inclined position.
Figure 12B:
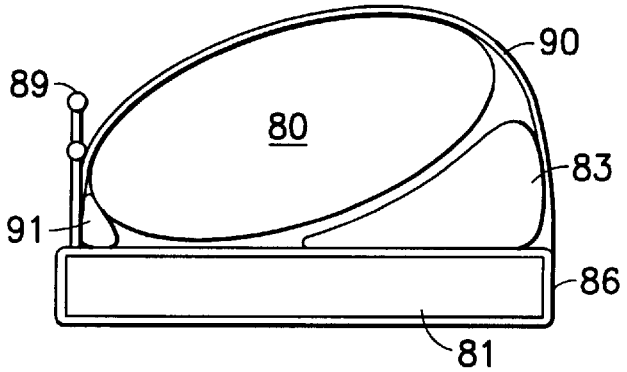
Figure 12C:
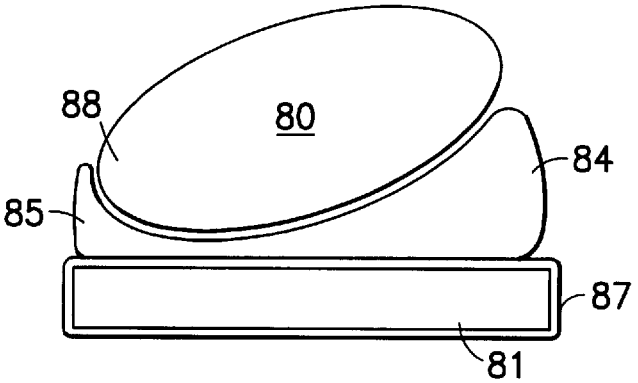

FIGS. 12A, 12B and 12C shown embodiments of the invention intended to position a person in an inclined position. The table 81 supports the weight of the support cushion device and the person 80. Characteristic of these embodiments, the supporting portion of the support cushion device 82, 83, 84 forms a wedge shaped member which raises one side of the person 80 off of the table 81. Not shown in FIGS. 12A, 12B and 12C, the wedge shaped member may be a composite structure of several bladders, constrained to the desired wedge shape. These bladders may be formed in the manner described above and include the several features of other embodiments of the invention, as desired. Therefore, for example, the inclination of the wedge may be dynamically controlled and damped, based on a dimension, e.g., inclination, for example to counter a force of a retractor, surgeon leaning on the patient, or surgical instrumentation.

FIG. 12A shows an inflatable wedge shaped support cushion 82 positioned below a mattress. Because it is not in contact with a person or patient, it may be easily reused. The inflatable wedge shaped support cushion 82 may be affixed to the table 81 by means not shown, such as a belt or fastener, or may be held in place by the frictional effects of the mattress 82 on the surface of the inflatable wedge shaped support cushion 82. In this instance, the body of the person 80 is laterally restrained by a separate means, such as a railing on the table 80, straps, a bolster above the mattress, or other known means.

FIG. 12B shows an inflatable wedge shaped support cushion 83 positioned adjacent to a person. Because it is in contact with or close proximity to a person or patient, it is preferably used only with that same person or patient or disposable. The inflatable wedge shaped support cushion 83 may be affixed to the table 81 by a belt 86 which encircles the table 81. In this instance, the body of the person 80 is laterally restrained, as in the embodiment shown in FIG. 12A, by a separate means, such as a railing 89 on the table 81, straps 90, webbing or belts, a bolster 91 on the table 80, or other known means. The lateral restraint advantageously is a strap which cooperates with the belt 86, so that the person and the inflatable wedge shaped support cushion 83 are restrained together to the table 81.

FIG. 12C shows an inflatable wedge shaped support cushion 84 positioned adjacent to a person, with an integral pneumatic lateral support structure 85. Because it is in contact with or close proximity to a person or patient, it is preferably used only with that same person or patient or disposable. The inflatable wedge shaped support cushion 84 and integral lateral support structure 85 may be affixed to the table 81 by a belt 87 which encircles the table 81. The lateral support structure 85 laterally restrains the body 80 of the person, reducing unintended rolling or slipping and supporting the lower flank 88 of the body 80. While not always required, additional restraining means, such as a railing or lip on the table 80, straps or other known means may be used to retain the person in place on the support cushion.

Thus, it can be seen that there are a number of possible variations in the implementation of embodiments of the support cushion according to the present invention. The scope of this invention is therefore defined by the claims.

What is claimed is:

1. A medical support system for adjustably supporting a torso of an immobilized anesthetized human in a lateral decubitus position above an operating table, said human torso having opposite lateral side surfaces, an anterior surface extending between the lateral side surfaces and a posterior surface extending between the lateral side surfaces, the support system comprising:

an inflatable pneumatic pillow having a front, a rear, opposed ends extending between the front and the rear, a substantially planar inferior surface extending continuously between the front, the rear and the ends for supporting disposition on the operating table, a plurality of substantially hollow air-filled support portions extending continuously between the ends of the pillow and disposed above the inferior surface, the hollow air-filled support portions being in air communication with one another and comprising an anterior support portion adjacent the front of the pillow, a posterior support portion adjacent the rear of the pillow and a lateral support portion between the anterior and posterior support portions, the support portions, in use, being configured such that the anterior support portion has a rearwardly and upwardly facing surface extending continuously between the ends of the pillow for supporting engagement of a portion of the torso adjacent the anterior surface and one of said lateral surfaces thereof, the lateral support portion has an upwardly facing concave surface extending continuously between the ends of the pillow for supporting engagement of a portion of said lateral surface of the torso, and the posterior support portion has an upwardly and forwardly facing surface extending continuously between the ends of the pillow for supporting a portion of the torso adjacent the posterior surface and said lateral surface, the anterior and posterior support portions both projecting upwardly from the inferior surface distances greater than the lateral support portion of the pillow; and means for controlling inflation of said inflatable member for selectively raising and lowering the torso relative to the operating table, whereby the inflatable pillow avoids a high concentration of forces on portions of the human torso opposed to the operating table, whereby the anterior and posterior support portions resist rolling of the torso for maintaining the lateral decubitus position, and whereby the air communication between the support portions enables a distribution of forces on the torso.

2. The system of claim 1, further comprising a pressure gauge to determine a pressure in said inflatable member.

3. The system of claim 1, wherein the means for controlling inflation comprises a bulb pump for inflating said inflatable member.

4. The system of claim 1, wherein the inferior support surface defines a width extending in a direction between the front and rear of the pillow, the lateral support portion further defining a width extending in a direction between said medial and lateral support portions, the width of the inferior surface being approximately twice as great as the width of the lateral support portion.

5. The system of claim 1, further comprising a valve for adjusting inflation of said inflatable member.

6. The system of claim 5, wherein the valve comprises a pressure relief valve.

* * * * *